United States Patent [19]

Widén

[11] Patent Number: 4,756,177

[45] Date of Patent: Jul. 12, 1988

[54] LOCK AND KEY BLADE

[75] Inventor: Bo Widén, Torshälla, Sweden

[73] Assignee: Widén Innovation AB, Torshälla, Sweden

[21] Appl. No.: 6,436

[22] Filed: Jan. 23, 1987

[30] Foreign Application Priority Data

Jan. 31, 1986 [SE] Sweden ..... 8600444

[51] Int. Cl.[4] ..... E05B 27/06

[52] U.S. Cl. ..... 70/364 A; 70/378; 70/358; 70/419; 70/421

[58] Field of Search ..... 70/362–366, 70/376–378, 392, 401, 406–407, 409, 419–421

[56] References Cited

U.S. PATENT DOCUMENTS

| | | | |
|---|---|---|---|
| Re. 30,198 | 1/1980 | Oliver et al. . | |
| D. 274,302 | 6/1984 | Widen . | |
| 758,026 | 4/1904 | Taylor . | |
| 2,023,847 | 12/1935 | Liss | 70/378 |
| 2,039,126 | 4/1936 | Svoboda . | |
| 3,035,433 | 5/1962 | Testa . | |
| 3,722,240 | 3/1973 | Spain et al. . | |
| 4,356,713 | 11/1982 | Widen . | |
| 4,393,673 | 7/1983 | Widen . | |
| 4,434,636 | 3/1984 | Prunbauer . | |
| 4,453,432 | 6/1984 | Widen . | |
| 4,507,944 | 4/1985 | Widen et al. . | |

FOREIGN PATENT DOCUMENTS

| | | |
|---|---|---|
| 0008310 | 3/1980 | European Pat. Off. . |
| 0065813 | 12/1982 | European Pat. Off. . |
| 0103532 | 3/1984 | European Pat. Off. . |
| 0110647 | 6/1984 | European Pat. Off. . |
| 7203658 | 1/1979 | Fed. Rep. of Germany . |
| 241373 | 7/1946 | Switzerland . |

*Primary Examiner*—Robert L. Wolfe

*Attorney, Agent, or Firm*—Birch, Stewart, Kolasch & Birch

[57] ABSTRACT

A rotary cylinder lock and a corresponding key blade are disclosed. The cylinder lock comprises a cylinder shell (19), a key plug (20) rotationally mounted in the shell (19) to provide a shear line (21) between the shell and the key plug, a key slot (11) extending into the key plug (20) parallel to the rotational axis thereof for receiving a key blade (1), at least one locking tumbler (**23*b*) including an elongated body portion guided in a complementary cavity (33*b*) in the key plug (20), the elongated body portion being capable of rotational movement about its longitudinal axis, and a fence member blockingly associated with the locking tumbler and shaped so that rotational positioning of said locking tumbler with a properly shaped key blade allows said fence member to clear the shear line. The locking tumbler (23*a*–23*e*) is further provided with a finger (23*bf*), which projects transversely outwardly from the rotational axis of the elongated body portion (23*b*) so as to pivot about the longitudinal axis of said elongated body portion during rotation of the latter, said finger (23*bf*) extending into the key slot (11**) for engagement with the key blade and therewith effecting rotational positioning of the elongated body portion of the locking tumbler.

43 Claims, 4 Drawing Sheets

Fig. 12
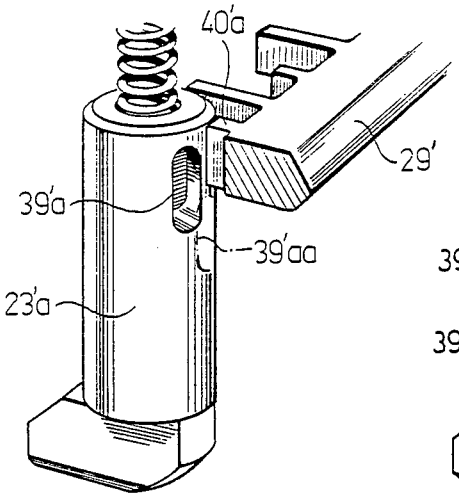
Fig. 12a
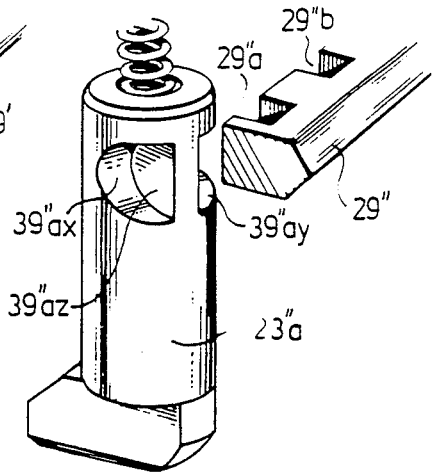
Fig. 13
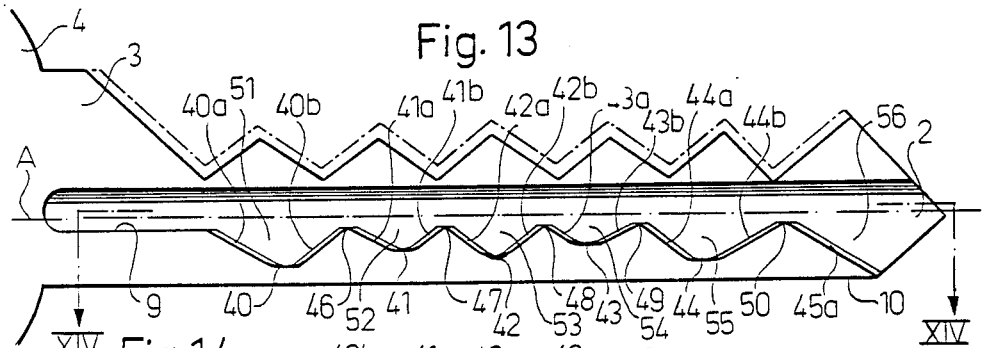
Fig. 14
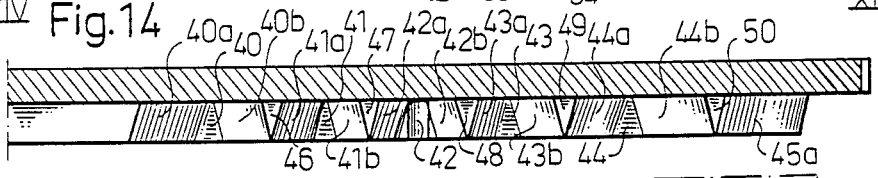
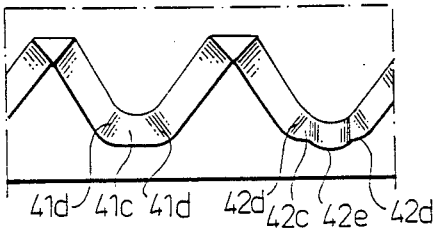
Fig. 15
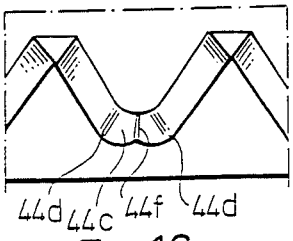
Fig. 16

LOCK AND KEY BLADE

The present invention relates generally to a lock and key system of the rotary cylinder type. More particularly, the cylinder lock is of the kind comprising a cylinder shell, a key plug rotationally mounted in the shell to provide a shear line between the shell and the key plug, a key slot extending into the key plug parallel to the rotational axis thereof for receiving a key blade, at least one locking tumbler including an elongated body portion guided in a complementary transverse cavity in the key plug, the elongated body portion being capable of rotational movement about its longitudinal axis, and a fence member blockingly associated with the locking tumbler and shaped so that rotational positioning of said locking tumbler with a properly shaped key blade allows the fence member to clear the shear line.

Such a lock is known from e.g. U.S. Pat. No. 3,499,302 (and a corresponding U.S. Pat. No. 30198—Oliver et al), the known lock including a row of cylindrical locking pins having chisel shaped lower end portions which cooperate with skew cuts in the upper edge of a key blade inserted into the key plug so as to correctly position each locking pin and to release the lock. Thus, to release the lock, each locking pin has to be positioned into a specific rotational and elevational position which allows the fence member to clear the shear line.

The object of the present invention is to further develop such a lock and key combination, comprising a new locking mechanism to be used instead of or in addition to the known mechanism discussed above, so as to

- obtain a very high number of code combinations by using rotationally and possibly also elevationally movable locking tumblers;
- secure a very high resistance against picking methods and making key impressions for obtaining a false key;
- keep down the space requirements of the key blade and the key slot while maintaining a very high number of code combinations;
- enable leaving major portions of the key blade free for conventional key profile grooves and other known or yet to be developed code patterns;
- permit the use of two different locking mechanisms, whereby the resistance against unauthorized manipulation will be high and the total number of code combinations virtually unlimited (up to at least 1,000,000,000);
- avoid the use of several different key ways in a lock system by replacing such different key ways with a new locking mechanism; and
- partially obstruct the keyway opening in the key plug to make unauthorized manipulation of the lock more difficult.

To achieve these aims, the cylinder lock according to the invention is characterized in that said at least one locking tumbler (in a lock of the kind stated in the first paragraph above) is further provided with a finger, which projects transversely outwardly from said longitudinal axis of said elongated body portion so as to pivot about the longitudinal axis of said elongated body portion during rotation of the latter, said finger extending into said key slot for engagement with said key blade and therewith effecting rotational positioning of the elongated body portion of the locking tumbler.

By arranging such locking tumblers in a row and also permit each locking tumbler with its associated finger to be moved reciprocally as well, a very high number of code combinations can be obtained.

Apart from increasing the number of code combinations, the new lock with the locking tumblers having pivotable fingers has many advantages corresponding to the various aims listed above.

It is admitted that some prior art locks have locking tumblers with projections extending transversely outwardly into the key slot so as to engage with an inserted key blade, e.g. the lock mechanism disclosed in U.S. Pat. No. 3,035,433 (Testa). However, the locking tumblers are constituted by plates which cannot be rotated. Therefore, most of the advantages obtained with the present invention are not present in this known lock mechanism.

Further suitable features of the lock according to the invention are stated in the sub-claims.

The present invention also includes a key blade to be used in combination with the new lock. According to a first aspect, the key blade, which comprises an elongated, wave-like, generally longitudinally extending code pattern for co-operation with a transversely projecting finger of each locking tumbler of the lock, is characterized in that the code pattern comprises a one-sided guiding surface for engagement with said pivotable finger of said locking tumbler, said guiding surface including at least one concavity location, including a bottom surface portion and adjoining straight side wall portions extending obliquely with respect to the longitudinal axis of the key blade, for positioning and supporting said pivotable finger, and sloping surface portions adjoining each of said side wall portions of said concavity location, at least a part of each sloping surface portion being bevelled and oriented so as to face away from the key blade and to enable a smooth, sliding contact with said pivotable finger when the key blade is being inserted into said lock.

According to another aspect of the invention, the key blade comprises a wave-like code pattern co-operating with pivotable fingers of a plurality of locking pins, said wave-like code pattern including longitudinally, and preferably also elevationally, displaced concavity locations corresponding to specific pivotal (and elevational) positions of said fingers upon insertion of the key blade into the key slot.

Moreover, the invention concerns specific parts of the lock, i.e. a locking tumbler and a fence member.

The invention will now be described more fully with reference to the appended drawings illustrating a preferred embodiment of the new lock and key combination.

FIG. 12 shows in a perspective view a modified embodiment of the locking pin of FIG. 7 and a part of a modified side bar;

Figure 1:
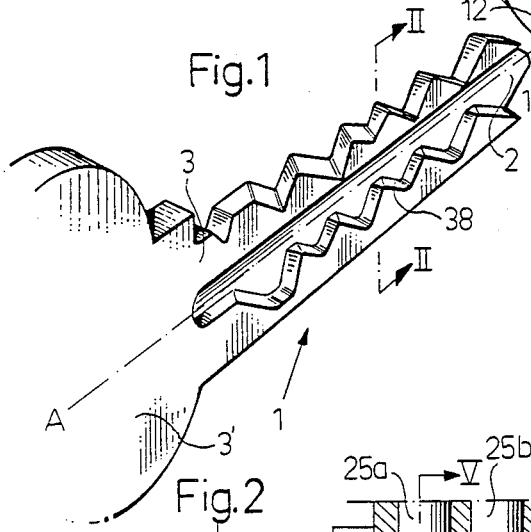
FIG. 1 illustrates a key blade in a perspective view.

FIG. 12*a* is a perspective view similar to FIG. 12 showing another modified embodiment of a locking pin and a corresponding side bar;

FIG. 13 is a side view, in a larger scale, of the key blade in FIG. 1;

FIG. 14 is a longitudinal section along line XIV—XIV in FIG. 13 illustrating a code pattern seen from above;

FIGS. 15 and 16 illustrate in perspective views (obliquely from above) various portions of the code pattern in the key blade, including different kinds of concavity locations co-operating with a finger extending from the locking pin of FIGS. 7, 9, 12 or 12*a*.

Figure 17:
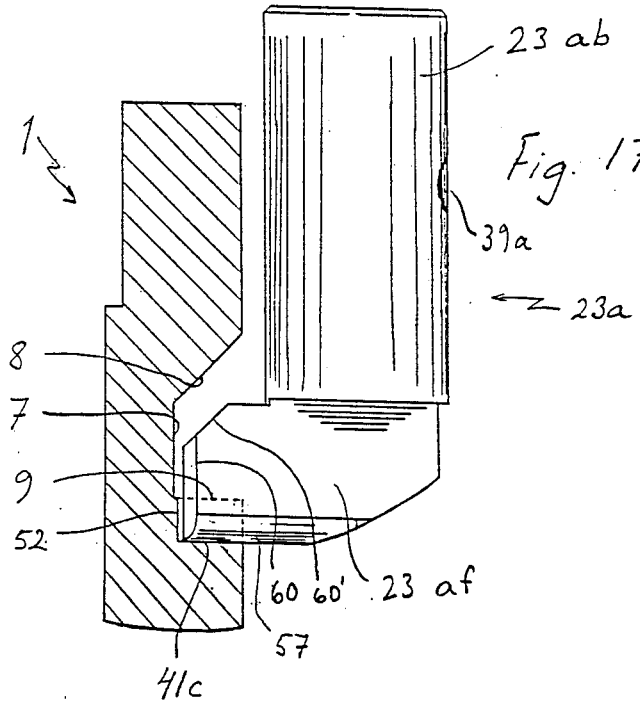
Figure 18:
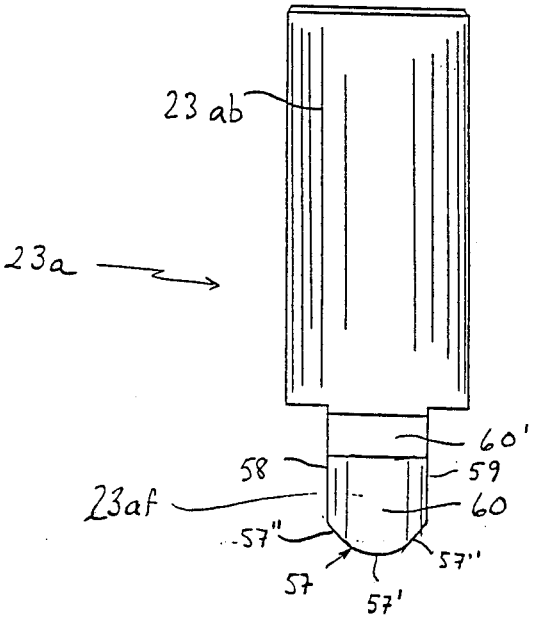

FIG. 17 shows (in a larger scale) the key blade in cross-section and a locking pin with a finger engaging a concavity location;

FIG. 18 shows (likewise in a larger scale) a side view of a locking pin and its finger (seen from its free end).

Figure 3:
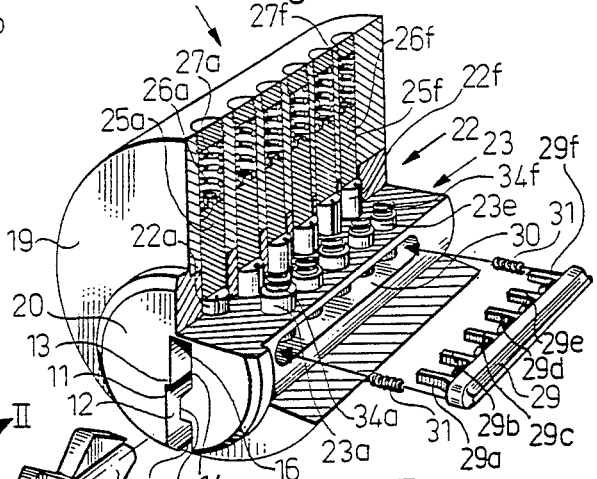
FIG. 3 illustrates a lock according to the invention to be used in combination with the key blade of FIG. 1, a part of the lock being broken away to show the inside thereof.

The key blade 1 shown in FIGS. 1 and 13 has a longitudinal axis A of insertion and is insertable into the lock shown in FIG. 3. The key blade 1 has a front end 2 and a rear end 3 adjoining a grip portion or bow 3' so as to form a complete key.

Figure 2:
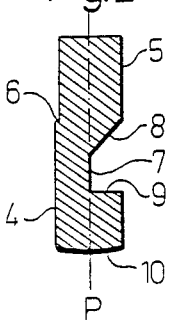
FIG. 2 is a transverse section along line II—II in FIG. 1.

As appears from FIG. 2, the key blade 1 is generally flat with substantially planar side surfaces 4 and 5. The side surface 4 to the left in FIG. 2 has a minor step 6, and the side surface 5 to the right in FIG. 2 has a longitudinal groove 7 with an upper side wall 8 inclined so as to face away from the blade 1 and a lower side wall 9 oriented substantially perpendicularly to the central plane P of the blade. Furthermore, the lower edge surface 10 is slightly curved. It will be apparent from FIGS. 1, 2 and 3 that the key blade 1 has a cross-sectional shape fitting into the key slot 11 of the lock. Thus, the key slot 11 has a generally rectangular cross-section and is confined by a left side wall 12 with a step 13 corresponding to the step 6 of the key blade, a right side wall 14 with a longitudinal ridge 15 matching the groove 7 of the key blade, a short upper straight wall 16 and a lower, slightly curved wall 17 matching the lower edge surface 10 of the key blade.

Figure 5:
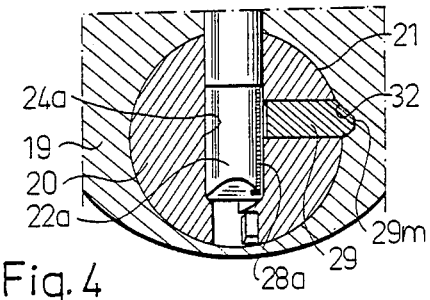
FIG. 5 is a transverse section along line V—V in FIG. 4.

The lock 18 is of the rotary cylinder type and comprises a cylinder shell 19, a key plug 20 rotationally mounted in the shell 19 to provide a shear line 21 (see FIGS. 5 and 6) between the shell 19 and the plug 20. The key slot 11 extends into the key plug 20 in parallel to the rotational axis thereof for receiving the key blade 1.

The lock 18 further includes two rows 22, 23 of locking tumblers or pins located in two mutually parallel planes. One row 22 of six locking pins 22*a*–22*f* is centrally located substantially in the central plane of the key slot 11. Each locking pin 22*a*–22*f* is guided for elevational and rotational movement in a cylindrical bore 24*a*–24*f*, respectively, in the key plug 20, each such bore communicating with the upper part of the key slot 11, so that the lower chisel end portion of each locking pin 22*a*–22*f* can engage with the V-shaped, skew cuts at the upper edge portion of the key blade 1 upon insertion of the key. A corresponding row 25 of upper driving pins 25*a*–25*f* are reciprocally guided in cylindrical bores 26*a*–26*f* in the cylinder shell 19 and are urged downwards by driving springs 27*a*–27*f* so as to effect a downwardly directed force on each locking pin 22*a*–22*f* (in the rotary position of the key plug 20 shown in FIG. 3, where the bores 24*a*–24*f* and 26*a*–26*f* register) or on the outer cylindrical surface of the key plug 20 (upon release and rotation thereof).

Figure 10:
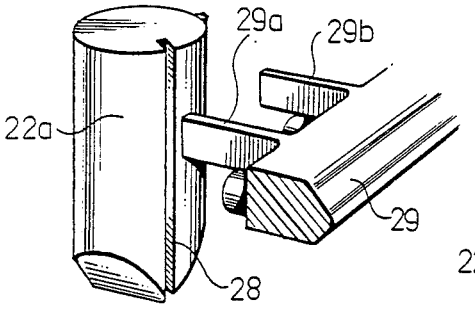
FIG. 10 is a perspective view, likewise in a larger scale, of another kind of locking pin included in the lock in FIG. 3 and a part of the side bar shown also in FIGS. 7 and 9.
Figure 11:
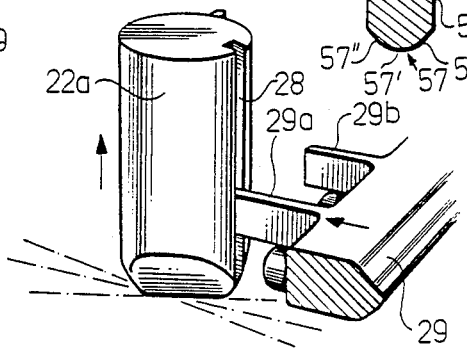
FIG. 11 is a perspective view similar to FIG. 10, wherein the locking pin registers with the side bar.

To clear the shear line 21 between the shell 19 and the plug 20, a key blade with a properly cut upper edge has to be inserted into the key slot, so that each locking pin 22*a*–22*f* is elevated into a position where the upper end surface thereof coincides with the shear line 21. Moreover, each locking pin 22*a*–22*f* must be rotated (by means of the skew cuts on the upper edge of the key blade) so that a longitudinal notch 28*a*–28*f*, respectively, in the cylindrical surface thereof is positioned to register (see FIGS. 10 and 11) with a (relatively long) lug 29*a*–29*f*, respectively, of a fence member or side bar 29, which is slidably engaged in a laterally opening slot 30 in the key plug 20. The side bar 29 is urged by springs 31 to a blocking position (see FIG. 5) in which a radially outwardly projecting cam portion 29*m* engages a corresponding cam groove 32 in the internal cylindrical surface of the shell 19. However, when all lugs 29*a*–29*f* register with the notches 28*a*–28*f* of the locking pins 22*a*–22*f*, the side bar is permitted to yield inwards against the action of the springs 31, when a rotary torque is applied between the plug 20 and the shell 19, whereupon the plug 20 can be rotated.

The locking mechanism described so far is previously known from the above-mentioned U.S. Pat. No. 3,499,302 (and U.S. Pat. No. Re. 30,198—Oliver et al.). However, the lock 18 also comprises a further locking mechanism including the above-mentioned row 23 of locking tumblers or pins.

Figure 4:
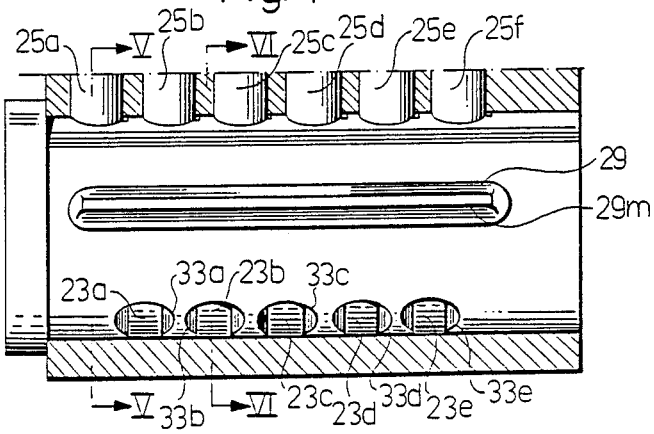
FIG. 4 is a side view of a key plug of the lock in FIG. 3.

This row of five locking tumblers or pins 23*a*–23*e* is laterally offset (to the right in FIGS. 3 and 6) but parallel to the row 22. Each locking pin 23*a*–23*e* is totally confined within the key plug 20 in a corresponding, cylindrical cavity or bore 33*a*–33*e*, respectively (see also FIGS. 4 and 6).

Figure 6:
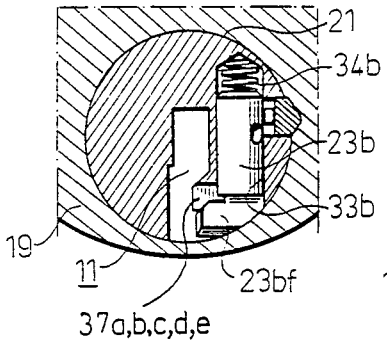
FIG. 6 is a transverse section along line VI—VI in FIG. 4.
Figure 7:
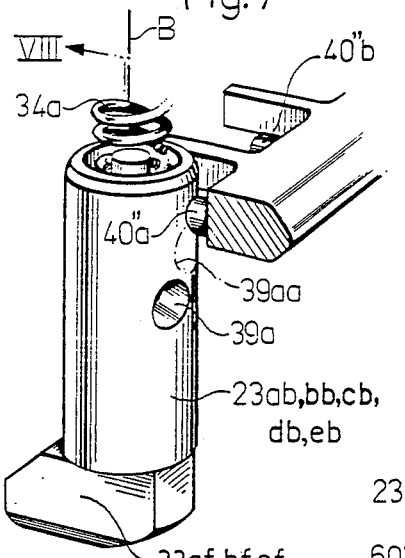
FIG. 7 is a perspective view, in a larger scale, of a locking pin and a part of a side bar forming parts of the lock in FIG. 3.
Figure 9:
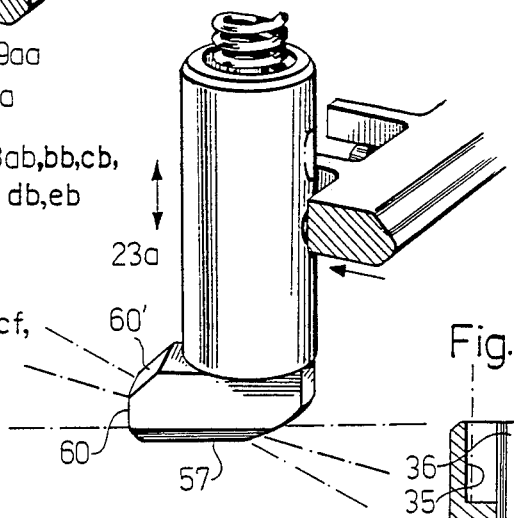
FIG. 9 is a perspective view similar to FIG. 7, wherein the locking pin is positioned to register with the side bar.
Figure 8:
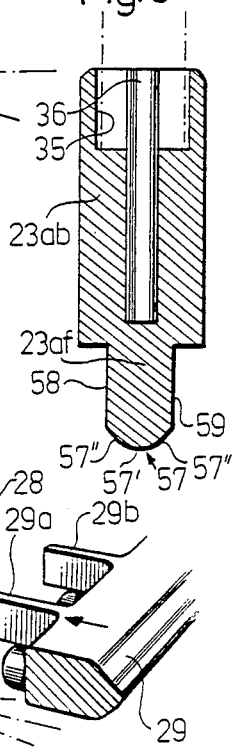
FIG. 8 is a longitudinal section along line VIII—VIII in FIG. 7.

Each locking pin 23*a*–23*e* is urged downwardly (as seen in the drawing figures) by a spring 34*a*–34*e*, respectively, acting between the bottom end of each bore 33*a*–33*e*, and the top of each locking pin 23*a*–23*e*. As shown in FIGS. 7, 8 and 9, the spring is partially accomodated and guided in an upper recess formed by a bore 35 (FIG. 8) and surrounds a central pin member 36 serving as drill protection. The respective locking pin 23*a*–23*e* comprises a cylindrical body portion 23*ab*–23*eb*, permitting rotational and elevational movement in the respective bore and a finger 23*af*–23*ef*, respectively, projecting transversely from the lower end of the body portion through corresponding openings 37*a*–37*e* in the key plug wall between the respective bore 33*a*–33*e* and the key slot 11. Thus, as seen in FIG. 6, the finger (23*bf*) extends partially into the key slot 11 adjacent to the ridge 15.

As will be explained further below, the engagement between the key blade 1 and the fingers 23*af*–23*ef* will cause each finger to pivot about the longitudinal axis B (FIG. 7) of the cylindrical body portion 23*ab*–23*eb*, respectively, and to be displaced upwardly and downwardly while contacting an elongated, wave-like code pattern 38 formed in the lower side wall 9 of the key blade groove 7. When the finger pivots and reciprocates, the corresponding cylinder body portion 23*ab*–23*eb* of the locking pin 23*a*–23*e* will perform a rotational and elevational movement. The corresponding spring 34*a*–34*f* urges the locking pin 23*a*–23*e* downwardly so as to secure a continuous contact between the finger 23*a*–23*e* and the code pattern 38 when the key blade 1 is being inserted into the key slot 11.

To permit such pivoting and reciprocating of the fingers 23*a*–23*e* the openings 37*a*–37*e* between the bores 33*a*–33*e* and the key slot 11 have greater vertical extension than the height of the finger (in a direction parallel to the longitudinal axis B in FIG. 7) and are wide enough to permit pivoting about 15° (in this particular embodiment) in each direction from a direction normal to the longitudinal axis of the key slot 11, preferably with side walls inclined so as to face the key slot 11 and to provide a well defined supporting abutment in each pivotal end position of the respective finger. These side walls also permit a smooth sliding engagement when the finger is being reciprocated upwardly and downwardly. To provide such a smooth sliding engagement, the side walls of each opening preferably extend in parallel to the longitudinal axis B of the cylindrical body portion of each locking pin and have a substantially complementary configuration relative to the side profile of the corresponding finger. In this way, at least a linear contact will be secured therebetween, whereby friction and wear will be reduced.

As appears from FIGS. 7, 9 and 12 the cylindrical body portion 23*ab*–23*eb* of each locking pin has at least one coded recess in the cylindrical mantle surface, said coded recess being dimensioned to receive a corresponding one of a set of relatively short lugs projecting from the side bar 29 between the longer lugs 29*a*–29*f* mentioned above.

In FIGS. 7 and 9, the coded recess is constituted by a cylindrical bore 39*a*, whereas the corresponding lug is a cylindrical pin 40″*a* fitting into the bore 39*a*. When the locking pins 23*a*–23*e* are positioned in predetermined elevational and rotational positions, the cylindrical pins 40″*a* will register with the cylindrical bores 39*a* and permit the side bar to be displaced transversely into its inward, seated position in the slot 30 of the key plug 20, thus releasing the lock (provided that the longer lugs 29*a*–29*f* also register with the notches 28*a*–28*f* of the locking pins 22*a*–22*f*).

In FIG. 12 there is shown a modified embodiment, wherein the recess in the cylindrical surface of the locking pin 23′*a* is constituted by an elongated slot 39′*a*, whereas the corresponding short lug of the side bar 29′ is constituted by a short bar 40′*a* (having a generally rectangular cross-section matching the shape of the elongated slot 39′*a*). In any case, the recess and the lug should be so designed that the locking pin is kept in a well-defined elevational and rotational position when the lug is fitted into the recess.

FIG. 12*a* shows another modified embodiment of the locking pin recess and a corresponding side bar 29″. Instead of a single hole or slot, there are two separate recesses 39″*ax* and 39″*ay* located at a distance from each other in the cylindrical surface of the locking pin 23″*a*, leaving a tongue portion 39″*az* therebetween. Each such recess 39″*ax*, 39″*ay* has been made by means of a cutter pin so as to form a substantially C-shaped configuration as seen along the cutter pin axis (not shown). The intermediate tongue portion 39″*az* is dimensioned to fit into a corresponding one (29″*a*) of parallel-epipedic recesses 29″*a*, 29″*b*, etc. formed in the side bar 29″ (provided that the respective locking pin is kept in a predetermined elevational and rotational position).

This embodiment has the additional advantage that the longitudinal, inner edges of the side bar will contact the sloping surfaces of the C-shaped recesses such that, in case the springs 31 (FIG. 3) do not suffice to withdraw the side bar from its inward seated position in the slot 30 of the key plug (for one reason or another), the side bar can be urged outwardly by a slight pull of the key resulting in elevation of the locking pins 23″*a*, etc. and a transverse force on the side bar 29″ (by way of the contact between the sloping recess surfaces and the lower longitudinal inner edge of the side bar. For this purpose, at least the lower recess surface should be sloping, whereas the upper recess surface may be horisontal. It is of course possible to make the longitudinal inner edges of the side bar slightly rounded to minimize wear.

Of course, even in this embodiment, the side bar 29″ may be provided with relatively long lugs (similar to lugs 29*a*–29*e* in FIG. 11) adapted to engage with an additional row of tumblers or pins (similar to pins 22*a*–22*f*).

To provide a master key system, each locking pin may have at least one further recess 39*aa*, 39′*aa*, as indicated by dash-dotted lines in FIGS. 8, 9 and 12.

Now, the code pattern 38 in the key blade 1 will be described with reference to FIGS. 1, 2, 13, 14, 15, 16, 17 and 18.

The groove 7 extending along the longitudinal axis A of the key blade 1 from the rear end 3 to the front end 2 has a depth corresponding to approximately half of the thickness of the blade, as will be seen from FIGS. 2 and 17. The depth is such that the free end of each finger 23*af*–23*ef* will always be located at some distance from the bottom wall of the groove. In any case, the bottom wall of the groove 7 does not interfere with the pivoting movement of the fingers. Instead, the pivoting and reciprocating of the fingers will solely be caused by the engagement, secured by the action of the springs 34*a*–34*e*, between the lower portion of the fingers and the code pattern 38 formed in the lower side wall 9 of the groove (see FIG. 17). Thus, the upper, unbroken, inclined side wall 8 of the groove does not either engage with the fingers.

The code pattern 38 is consequently constituted by a one-sided, wave-like guiding surface including a number of concavity locations 40, 41, 42, 43, 44 and adjoining sloping surface portions 40*a*, 40*b*, 41*a*, 41*b*, 42*a*, 42*b*, 43*a*, 43*b*, 44*a*, 44*b* extending between each concavity location and the remaining portions of the groove side wall 9 so as to leave substantially planar top portions 46, 47, 48, 49 and 50 between each pair of adjacent sloping surface portions, there being a further sloping surface portion 45*a* reaching all the way to the lower edge 10 of the key blade adjacent to the front end 2 thereof so as to provide an inlet guiding surface permitting each finger 23*af*–23*ef* to enter into engagement with the wave-like code pattern when the key blade 1 is being inserted into the key slot 11.

The recesses formed in the lower side wall 9 of the groove 7 to provide the code pattern 38 have substantially the same depth as the groove 7 itself. Thus, the inside portions 51, 52, 53, 54, 55, 56 of these recesses form planar extensions of the bottom wall of the groove 7 and do not interfere with the fingers 23*af*–23*ef*.

Each concavity location 40, 41, 42, 43, 44 has a bottom surface portion (41*c*, 42*c* and 44*c* in FIGS. 15 and 16), which is generally triangular and oriented so as to face upwardly and which extends substantially normal to the central plane P of the blade (see FIG. 2) and in parallel to the longitudinal axis A of the blade (see FIG. 13). The triangular configuration of the bottom surface portions is such as to provide a well-defined support of the respective finger, both in the process of inserting the key blade, in which case the finger will swing from one pivotal end position to the other while the respective concavity location of the blade passes by the location of one of the locking pins 23*a*–23*e* of the lock, and when reaching the fully inserted position of the key blade in the key slot, in which case the fingers will be directed in various predetermined pivotal positions, e.g. in a straight transverse position or in a pivotal end position where the finger is directed obliquely towards the front or rear end of the key blade (compare the three dash-dotted lines in FIG. 9).

To provide such a support the generally triangular bottom surface portion (41*c*, 42*c*, and 44*c*) has adjoining straight side wall portions, as denoted by numerals 41*d*, 42*d* and 44*d* in FIGS. 15 and 16, these side wall portions extending obliquely with respect to the longitudinal axis A of the key blade.

Preferably, the bottom surface portion 41*c*, etc. merges smoothly with the adjoining side wall portions 41*d*, etc. with a curvature corresponding essentially to a lower convexly curved, e.g. cylindrical surface portion 57 of the respective finger. Also, the oblique direction of each side wall portion 41*d* etc. should correspond essentially to the end position pivotal direction of the finger so as to provide a linear or surface contact between the finger and the respective side wall portion.

As illustrated in FIG. 15 (to the right), at least one of the bottom surface portions (42*c*) may be provided with a part cylindrical recess 42*e*, the cylinder axis of which recess extends perpendicularly to the longitudinal axis A of the key blade so as to provide a well-defined support of a finger in a corresponding straight transverse position.

It is also possible, to facilitate the manufacture by means of an end mill cutter broach, to leave a shallow, central, transverse ridge 44*f* in the middle of the bottom surface portion 44*c*, as illustrated in FIG. 16.

The sloping surface portions 40*a,b*, 41*a,b*, 42*a,b*, 43*a,b*, 44*a,b* adjoining the side wall portions 41d, etc. as well as the inlet sloping surface portion 45*a* are generally parallel to the oblique direction of the side wall portions 41*d*–44*d* and thus form bevel surfaces facing away from the key blade. In this way, the lower curved portions 57 of the fingers will engage the sloping surface portions with a linear contact so as to reduce the wear of the mutually contacting surfaces when the fingers slide along these sloping surface portions of the wave-like code pattern. To provide such a linear contact, it is sufficient that only an outer part of the sloping surface portions is bevelled. Moreover, such a partial bevel may be extended over the concavity locations, since the inner parts of the bottom and side wall portions thereof will provide sufficient support.

The dimensions of the concavity locations are adapted to match the geometric shape and dimensions of the fingers so as to provide an effective positioning and support of the fingers in their predetermined pivotal positions.

In the preferred, illustrated embodiment, each finger 23*af*–23*ef* is located adjacent to the lower end of the cylindrical body portion 23*ab*–23*eb* and extends transversely substantially along the whole diagonal width of the cylindrical body portion and projects outwardly therefrom. Each finger has a generally rectangular cross-section with a convexly curved, e.g. partly cylindrical lower surface, the curvature of which corresponding essentially to the support surface portions of the concavity locations of the code pattern and with planar, mutually parallel side surfaces 58, 59. The inner end of the finger, i.e. the end adjacent to the cylindrical body portion, is convexly curved so as to provide a smooth contact with the cylinder shell 19 (see FIG. 6). The free end surface 60 of the finger does not contact any part of the key blade or the lock, and the configuration thereof is not critical. However, there is shown a slight upper bevel 60' (FIGS. 9, 17 and 18) serving to ensure that the finger does not make contact with the upper inclined wall 8 of the groove 7 in the key blade.

It is to be noted that the surfaces 57 and 58, 59 of the finger make contact with different parts of the key blade and the lock. Thus, the central cylindrical part 57' of the lower surface 57 makes contact only with the bottom surface portions of the concavity locations 40–44 of the code pattern, whereas the substantially planar, inclined portions 57" of the lower surface 57 ride on the bevelled sloping surface portions 40*a,b*–45*a*, and the planar side surfaces 58, 59 abut and slide along the side walls of the openings 37*a*–37*e*. Thus, even if a certain wear occurs on the side surfaces 58, 59 and the planar portions 57", such wear will not affect the positioning of the fingers in the concavity locations, since such positioning only involves the lowermost cylindrical surface part 57'.

The lock can be modified considerably within the scope of claim 1. Thus, it is conceivable to use only a single row of locking pins, although a dual locking mechanism will provide a greater number of code combinations. Of course, the number of locking pins in a row can be varied, and only a single locking tumbler or pin is possible, especially if combined with some other locking mechanism.

Two rows of locking pins according to the invention can be used, e.g. one row on each side of the key slot.

Also, the longitudinal axes of the locking pins may be somewhat inclined relative to the central plane of the key slot. However, it is preferred that the finger is oriented substantially perpendicularly to said central plane of the key slot, at least if the code pattern is located in a groove on the side of the key blade. However, the code pattern may also be located on a step or shelf surface on the side of the key blade, or even at either longitudinal edge of the blade.

The number of possible pivotal positions of the locking pins may be varied, e.g. two, three, four or five being practically possible, although two or three pivotal positions seem to be preferable.

The locking pins should be biassed so as to continuously make contact with the code pattern on the key blade. However, instead of springs, magnetic elements may be used to accomplish such a biassing force.

The rotatable locking pins may co-operate separately with associated fence members, but a common side bar seems to be most practical.

I claim:

1. A cylinder lock comprising a cylinder shell (19);

a key plug (20) rotationally mounted in said cylinder shell (19) to provide a shear line between said cylinder shell and said key plug;

a key slot (11) extending into said key plug (20) parallel to the rotational axis thereof for receiving a key blade (1);

at least one locking tumbler (23*a*–23*e*) including an elongated body portion (23*ab*–23*eb*) guided in a complementary, transverse cavity (33*a*–33*e*) in said key plug (20), the elongated body portion being capable of rotational movement about a longitudinal axis (B); and a fence member (29) blockingly associated with said locking tumbler (23*a*–23*e*) and shaped so that rotational positioning of said locking tumbler with a properly shaped key blade allows said fence member to clear the shear line;

characterized in that said at least one locking tumbler (23*a*–23*e*) is further provided with a finger (23*af*–23*ef*), which projects transversely outwardly from said longitudinal axis of said elongated body portion (23*ab*–23*eb*) so as to pivot about said longitudinal axis (B) of said elongated body portion during rotation of the latter, said finger (23*af*–23*ef*) extending into said key slot (11) for engagement with said key blade (1) and therewith effecting rotational positioning of the elongated body portion of the locking tumbler.

2. A cylinder lock as defined in claim 1, characterized in that said at least one locking tumbler (23*a*–23*e*) is totally confined within said key plug (20).

3. A cylinder lock as defined in claim 1, characterized in that said locking tumbler is a locking pin.

4. A cylinder lock as defined in claim 3, characterized in that said body portion is cylindrical and said complementary, transverse cavity is a bore.

5. A cylinder lock as defined in claim 3 or 4, characterized by a plurality of said locking pins (23*a*–23*e*) in a row (23), each pin having a finger (23*af*–23*ef*), each pin being guided in a cavity (33*a*–33*e*) and each pin being blockingly associated with a fence member (29, 29', 29'').

6. A cylinder lock as defined in claim 5, characterized in that said cavities (33*a*–33*e*) are located at equal distances along said row (23).

7. A cylinder lock as defined in claim 5, characterized in that said body portion (23*ab*–23*eb*) of each pin is capable of reciprocal movement along its longitudinal axis (B), wherein engagement of each finger (23*af*–23*ef*) with said key blade effects elevational positioning of the corresponding body portion to allow said fence member (29) to clear the shear line.

8. A cylinder lock as defined in claim 7, characterized in that each of the locking pins (23*a*–23*e*) is reciprocally movable against associated biassing means (34*a*–34*e*) resiliently urging said finger of each locking pin to maintain contact with said key blade when the latter is being inserted into the key slot.

9. A cylinder lock as defined in claim 5 for use in combination with a key blade, which includes an elongated generally longitudinally extending wave-like code pattern (38), characterized in that said code pattern (38) is shaped for engagement with said finger (23*af*–23*ef*) of each locking pin to effect rotational positioning of said body portion (23*ab*–23*eb*) of each locking pin to allow the fence member (29) to clear the shear line.

10. A cylinder lock as defined in claim 9, characterized in that said code pattern of the key blade is shaped for engagement with said finger of each locking pin to effect elevational positioning of said body portion of each locking pin to allow the fence to clear the shear line.

11. A cylinder lock as defined in claim 10, characterized in that said code pattern of the key blade includes longitudinally and elevationally displaced concavity locations (40–44) in which a free end portion of each finger is engaged in a predetermined pivotal and elevational position.

12. A cylinder lock as defined in claim 9, characterized in that transversely projecting fingers (23*af*–23*ef*) of said locking pins are located at such elevational positions relative to said key slot (11) as to contact said wave-like code pattern (38) on the side portion (5) of said key blade when the key blade is being inserted into said key slot.

13. A cylinder lock as defined in claim 9, characterized in that at least a free end portion of said finger (23*af*–23*ef*) of each locking pin has a convexly curved surface (57) so as to provide a smooth contact with said wave-like coded pattern (38) of the key blade while inserting the key blade into said key slot.

14. A cylinder lock as defined in claim 13, characterized in that the convexly curved surface (57) is at least partly cylindrical.

15. A cylinder lock as defined in claim 5, characterized in that said finger (23*af*–23*ef*) of each locking pin is positioned at an end portion of said body portion (23*a*-*b*–23*eb*).

16. A cylinder lock as defined in claim 5, characterized by a row of transverse openings (37*a*–37*e*) in said key plug (20) and adjoining said key slot (11), the transverse openings extending between said key slot and a corresponding one of said complementary cavities (33*a* ∝ 33*e*), wherein the fingers (23*af*–23*ef*) of the locking pins project through the transverse openings into said key slot, each of the transverse openings being wide enough to permit a respective finger to pivot about and to be elevated in parallel to the longitudinal axis (B) of the associated body portion (23*ab*–23*eb*).

17. A cylinder lock as defined in claim 16, characterized in that each transverse opening (37*a*–37*e*) includes side surfaces extending substantially in parallel to the longitudinally axis (B) of the body portion (22*ab*–23*eb*) so as to provide an abutment and to permit the corresponding finger to slide on a side surface along the abutment when the corresponding locking pin moves elevationally.

18. A cylinder lock as defined in claim 16, characterized in that each of said fingers has side surfaces which are complementary to the side surfaces of said transverse openings, whereby, in each pivotal end position of the finger, a large contact area will be provide between the respective surfaces.

19. A cylinder lock as defined in claim 16, characterized by a longitudinal rib portion (15) of said key plug (20) positioned to form a side recess in a transverse profile contour of said key slot (11) in the region of said transverse openings (37).

20. A cylinder lock as defined in claim 5, characterized in that said body portion (23*ab*–23*eb*) of each locking pin has at least one recess (39*a*) in its lateral surface at a preselected location, and wherein said fence member (29) includes a projection (40″*a*) which is extendable into said recess to release the fence member and permit the plug (20) to be rotated in said shell (19) when said body portion is correctly positioned upon engagement of said finger with said properly shaped key to present said recess to said projection.

21. A cylinder lock as defined in claim 5, characterized in that each of said complementary cavities opens into a cylindrical surface of said key plug (20).

22. A cylinder lock as defined in claim 5, characterized in that said fence member comprises a side bar (29) extending longitudinally along said shear line.

23. A cylinder lock as defined in claim 5, characterized in that said row of locking pins comprises a first row (23) of locking pins, said complementary cavities comprises a first row of cavities, the cylinder lock further including a second row (22) of second locking pins being guided in a second row of second cavities.

24. A cylinder lock as defined in claim 23, characterized in that said fence member (29) cooperates operatively with said first locking pins and said second locking pins.

25. A cylinder lock as defined in claim 22, characterized in that said side bar (29) includes transverse lugs (29*a*–29*f*,40″*a*) distributed along the length thereof and adapted to fit into coded recesses (28,39*a*) in said locking pins so as to enable a transverse movement of the side bar to clear said shear line when all locking pins are correctly positioned upon insertion of said key into said key slot.

26. A cylinder lock as defined in claim 25, characterized in that said second locking pins (22*a*–22*f*) are located at positions which are offset in the longitudinal direction of the cylinder lock relative to the positions of said first locking pins (23*a*–23*e*).

27. A cylinder lock as defined in claim 26, characterized in that said lugs include a set of first, shorter lugs (40″*a*) adapted to fit into the recesses (39*a*) of said first locking pins and a set of second, longer lugs (29*a*–29*f*) being offset from the first lugs in the longitudinal direction of the side bar and adapted to fit into the recesses (28) of said second locking pins (22*a*–22*f*).

28. A cylinder lock as defined in claim 27, characterized in that said rows (22,23) of first and second cavities have longitudinal axes located in first and second planes which are parallel to each other.

29. A key blade for use in combination with a cylinder lock as defined in claim 1, comprising an elongated, wave-like, generally longitudinally extending code pattern (38) for co-operation with a transversely projecting finger of each locking tumbler of said lock, characterized in that said code pattern comprises a one-sided guiding surface for engagement with said pivotable finger (23*af*–23*ef*) of said locking tumbler, said guiding surface including at least one concavity location (40–44) including a bottom surface portion (41*c*,42*c*,44*c*) and adjoining straight side wall portions (41*d*,42*d*,44*d*) extending obliquely with respect to the longitudinal axis (A) of the key blade, for positioning and supporting said pivotable finger, and sloping surface portions (40*a*,*b*–44*a*,*b*) adjoining each of said side wall portions (41*d*,42*d*,44*d*) of said concavity location, at least a part of each sloping surface portion (40*a*,*b*–44*a*,*b*) being bevelled and oriented so as to face away from the key blade and to enable a smooth, sliding contact with said pivotable finger when the key blade is being inserted into said lock.

30. A key blade for use in combination with a cylinder lock as defined in claim 5, characterized in that said key blade comprises a wave-like code pattern (38) co-operating with said pivotable fingers (23*af*–23*ef*) of said locking pins (23*a*–23*e*), said wave-like code pattern (38) including longidutinally (A) displaced concavity locations (40–44) located so as to correspond to specific pivotal positions of said fingers upon insertion of said key blade (1) into said key slot (11).

31. A key blade as defined in claim 30, characterized in that said concavity locations (40–44) are displaced also in a transversal direction so as to correspond to specific elevational positions of said fingers upon insertion of said key blade into said key slot.

32. A cylinder lock as defined in claim 1, character in that said elongated body portion (23″*a*) has a pair of mutually spaced recesses (39″*ax*, 39″*ay*) forming a tongue member (39″*az*) therebetween, said tongue member being dimensioned to fit into a recess (29″*a*) formed in said fence member 29″).

33. A cylinder lock as defined in claim 32, comprising a row of locking pins (23″*a*) being blockingly associated with a common side bar (29″), each pin being capable of elevational and rotational movement, characterized in that each of said mutually spaced recesses (39″*ax*,39″*ay*) includes a sloping surface portion, which is shaped so as to effect a lateral force on the side bar when the pins are being elevated.

34. A locking tumbler for use with a cylinder lock having a cylinder shell (19), a key plug (20) rotationally mounted in said cylinder shell to provide a shear line between in said cylinder shell and said key plug, a key slot (11) extending into said key plug parallel to the rotational axis thereof for receiving a key blade (1), said locking tumbler (23*a*–23*e*) comprising:

an elongated body portion (23*ab*–23*eb*) extending and being guided within a complementary, transverse cavity (33*a*–33*e*) in said key plug, said elongated body portion being capable of rotational movement about a longitudinal axis (B);

a fence member (29) blockingly associated with said locking tumbler end shaped so that rotational positioning of said locking tumbler with a properly shaped key blade allows said fence member to clear the shear line;

said locking tumbler includes a finger (23*af*–23*ef*) having a first end affixed to one end of said elongated body portion and a second end extending outwardly therefrom and terminating in a free end (60) so as to pivot about said longitudinal axis of said elongated body portion during rotation of the latter, said finger extending into said key slot for engagement with said key blade for effecting rotational positioning of the elongated body portion of the locking tumbler.

35. A locking tumbler as defined in claim 34, characterized in that said locking tumbler is a locking pin, said body portion is cylindrical and said complementary transverse cavity is a bore.

36. A fence member for use with a cylinder lock having a cylinder shell (19), a key plug (20) rotationally mounted in said cylinder shell to provide a shear line between said cylinder shell and said key plug, a key slot

(11) extending into said key plug parallel to the rotational axis thereof for receiving a key blade (1), a plurality of locking tumblers (23*a*–23*e*) arranged in a row, each locking tumbler including an elongated body portion extending and being guided within a complementary, transverse cavity (33*a*–33*e*) in said key plug, said elongated body portion (23*ab*–23*eb*) being capable of rotational movement about a longitudinal axis (B), each said locking tumbler includes a finger (23*af*–23*ef*) having a first end affixed to one end of said elongated body portion and a second end extending outwardly therefrom and terminating in a free end (60) so as to pivot about said longitudinal axis of said elongated body portion during rotation of the latter, said finger extending into said key slot for engagement with said key blade for effecting rotational positioning of the elongated body portion of the locking tumbler, a plurality of locking pins (22*a*–22*f*) arranged in a row spaced from said plurality of locking tumblers (23*a*–23*e*), said fence member comprising:

a fence bar (29,29',29'') blockingly associated with said locking tumblers and said locking pins and shaped so that rotational positioning of said locking tumblers and engagement with a properly shaped key blade allows said fence bar to clear the shear line;

said fence bar including a first plurality of projections (40''*a*,40'*a*, between 29''*a* and 29''*b*) extending outwardly therefrom a first predetermined distance for engagement with said plurality of locking tumblers (23*a*–23*e*) and a second plurality of projections (29*a*–29*f*) extending outwardly therefrom a second predetermined distance for engagement with said plurality of locking pins (22*a*–22*f*).

37. A fence member according to claim 36, wherein said first plurality of projections (40''*a*,40'*a*) extending from said fence bar (29,29') engage aperatures (39*a*,39'*a*) in said locking tumblers for releasing said fence bar to clear the shear line when the locking tumblers are properly aligned relative to said projections.

38. A fence member according to claim 36, wherein said first plurality of projections (between 29''*a* and 29''*b*) extending from said fence bar (29'') engage a tongue member (39''*az*) formed in said locking tubmlers for releasing said fence bar to clear the shear line when the locking tumblers are properly aligned relative to said projections.

39. A fence member according to claim 36, wherein said second predetermined distance of said second plurality of projections is longer than said first predetermined distance of said first plurality of projections.

40. A cylinder lock as defined in claim 24, characterized in that said side bar (29) includes transverse lugs 29*a*–29*f*, 40''*a*) distributed along the length thereof and adapted to fit into coded recesses (28, 39*a*) in said locking pins so as to enable a transverse movement of the side bar to clear said shear line when all locking pins are correctly positioned upon insertion of said key into said key slot.

41. A cylinder lock as defined in claim 40, characterized in that said second locking pins (22*a*–22*f*) are located at positions which are offset in the longitudinal direction of the cylinder lock relative to the positions of said first locking pins (23*a*–23*e*).

42. A cylinder lock as defined in claim 41, characterized in that said lugs include a set of first, shorter lugs (40''*a*) adapted to fit into the recesses (39*a*) of said first locking pins and a set of second, longer lugs (29*a*–29*f*) being offset from the first lugs in the longitudinal direction of the side bar and adapted to fit into the recesses (28) of said second locking pins (22*a*–22*f*).

43. A cylinder lock as defined in claim 42, characterized in that said rows (22, 23) of first and second cavities have longitudinal axes located in first and second planes which are parallel to each other.

* * * * *